United States Patent [19]

Houlachi et al.

[11] 4,146,447

[45] * Mar. 27, 1979

[54] ARSENIC REMOVAL FROM ELECTROLYTES

[75] Inventors: George J. Houlachi, St. Laurent; Pierre L. Claessens, St. Eustache, both of Canada

[73] Assignee: Noranda Mines Limited, Toronto, Canada

[ * ] Notice: The portion of the term of this patent subsequent to Apr. 11, 1995, has been disclaimed.

[21] Appl. No.: 862,500

[22] Filed: Dec. 20, 1977

Related U.S. Application Data

[63] Continuation-in-part of Ser. No. 710,866, Aug. 2, 1976, Pat. No. 4,083,761.

[51] Int. Cl.[2] ..... C25C 1/12

[52] U.S. Cl. ..... 204/130; 204/108; 204/DIG. 9

[58] Field of Search ..... 204/108, 130, DIG. 9

[56] References Cited

U.S. PATENT DOCUMENTS

| | | | |
|---|---|---|---|
| 1,534,709 | 4/1925 | Holt | 204/DIG. 9 |
| 2,606,147 | 8/1952 | Chester | 204/DIG. 9 |
| 3,824,162 | 7/1974 | Sakai et al. | 204/108 |
| 3,864,227 | 2/1975 | Brytczuk et al. | 204/108 |

OTHER PUBLICATIONS

"Principles of Electroplating & Electroforming", by W. Blum et al., 3rd Ed., 1949, pp. 246-247.

"Extractive Metallurgy of Cu", by A. K. Biswas et al., 1st Ed., 1976, pp. 295-323.

*Primary Examiner*—R. L. Andrews

*Attorney, Agent, or Firm*—Fleit & Jacobson

[57] ABSTRACT

A method is provided for removing arsenic from arsenic and copper containing electrolytes by electrolysis while minimizing or substantially reducing the formation of arsine gas, through the application of a periodically reversed or interrupted current during such electrolysis. The method is particularly suitable for the purification of copper refinery electrolyte.

20 Claims, 5 Drawing Figures

25
2.0
1.5
1.0
0.5
PPM in stack for 18 cells operating with Fresh Cathodes
40°C
65°C
70°C
1
2
3
4
Duration of electrolysis, Hours Δ 5 U.S. Gal./min.
O 60 U.S. Gal./min.
~ 0.5 lb/day
~ 0.05 lb/day
PPM $Ag_2O$ in stack for 16 cells operating with fresh Cathodes
0.4
0.35
0.3
0.25
0.2
0.15
0.1
0.05
1
2
3
4
5
Duration of electrolysis, Hours

ARSENIC REMOVAL FROM ELECTROLYTES

This is a continuation-in-part of application Ser. No. 710,866 filed Aug. 2, 1976 now U.S Pat. No. 4,083,761.

This invention relates to a novel method of removing arsenic from arsenic and copper containing electrolytes by electrolysis while minimizing or substantially reducing the formation of toxic arsine gas. More particularly, the method provides for the application of a periodically reversed or interrupted current during electrolysis leading to deposition of arsenic, copper and eventually other metallic elements present in the electrolyte onto the cathode while substantially reducing the formation of arsine gas which would normally be formed at the cathode under the same electrolysis conditions, but with the conventional application of direct current.

The novel method is particularly suitable for the purification of copper refinery electrolyte.

The use of periodically reversed current has been well known in the electroplating industry for a good number of years. For example, in U.S. Pat. No. 1,534,709, issued to F. A. Holt on Apr. 21, 1925, there is described a method of conducting electrolytic operations in which periodic reversal of the current is used to depolarize the electrodes during the electroplating of copper from an acid bath at high current density. U.S Pat. Nos. 2,451,341 of Oct. 12, 1948 and 2,575,712 of Nov. 20, 1951, both in the name of G. W. Jernstedt, describe other methods of electroplating of metals selected from the group consisting of copper, brass, silver, zinc, tin, cadmium and gold with the use of periodic reverse current.

It is also known to use periodically reversed current in the electrolytic refining of copper, as described, for example, in British Patent specification No. 1,157,686 in the name of Medodobiven Kombinat "Georgi Damianov", published on July 9, 1969, and U.S. Pat. Nos. 3,824,162 of July 16, 1974 to Kenichi Sakii et al. and 3,864,227 of Feb. 4, 1975 to Walter L. Brytczuk et al.

Furthermore, there are also known processes for applying periodically reversed current for the electrowinning of copper (Canadian Pat. No. 876,284 of July 20, 1971 to Donald A. Brown et al.) and for the electroextraction of zinc (Canadian Pat. No. 923,845 of Apr. 3, 1973 to Ivan D. Entshev et al.).

The present applicants have now found a new and a very surprising application of periodically reversed as well as periodically interrupted current for the purpose of removing arsenic from arsenic and copper containing electrolytes while minimizing or substantially reducing the formation of toxic arsine gas which is a constant health hazard in such operations.

It is well known, for example, that, during electrorefining of impure copper, the impurities present in the anode are either dissolved into the solution as soluble compounds or precipitated in the form of insoluble compounds. To avoid contamination of the cathode copper, it is essential to control the concentration of undesired soluble impurities by purification of the electrolyte. Such electrolyte purification is carried out by passing a part of the tankhouse solution through the so-called liberator cells containing insoluble anodes, such as anodes made of lead or lead alloys, whose main purpose is to control the copper level of the electrolyte. After partial decopperization of the electrolyte, the solution is directed into purification cells, which are electrowinning cells where copper is depleted to low levels and, meanwhile, arsenic, antimony, bismuth and possible other impurities are co-deposited onto the cathode, thus providing a means of controlling the concentration of these impurities in the electrolyte. During this co-deposition, arsenic is reduced at the cathode to its metallic form and at low copper concentrations to its hydride form, thus liberating the toxic arsine gas. The liberation of this arsine gas presents a major problem for every copper refinery in the world since it constitutes a constant health hazard to its workers. It is known that arsine gas is extremely toxic and an exposure thereto in a concentration of 250 ppm for thirty minutes is fatal while exposure to concentrations as low as 10 ppm can cause poisoning symptoms in a few hours (cf. American Conference of Governmental Industrial Hygienists: Threshold Limit Values for 1964, AMA Arch. Environ. Health 9:545 (1964)). It is, therefore, extremely important to minimize the evolution of arsine gas in all operations involving electrodeposition of arsenic from electrolytic solutions. A good agitation of the electrolyte as well as application of low current densities and high electrolyte temperatures have been found to decrease the rate of arsine gas formation. However, these methods alone are not sufficient in themselves and, consequently, they are normally accompanied by a strong ventilation system to avoid dangerous concentrations of the toxic arsine gas close to the purification cell. Obviously, such ventilation system merely transports the toxic gas from one place to another, namely from the workroom to the atmosphere and this may be found unacceptable by the ever stricter anti-pollution regulations implemented by the various governmental authorities. Furthermore, ventilation systems are prone to breakage and require a great deal of maintenance. The process of the present invention minimizes or substantially reduces the formation of the arsine gas at the source, namely at the cathode and, consequently, to a great extent obviates the disadvantages encountered heretofore.

Basically, therefore, the present invention provides a method of removing arsenic from arsenic and copper containing electrolytes, wherein the copper concentration reaches such low levels that toxic arsine gas would be formed at the cathode during electrolysis, which comprises carrying out an electrodeposition of the arsenic on cathodes by applying through the electrolyte a suitable direct current and periodically reversing the polarity of the current or periodically interrupting said current, such as to minimize or substantially reduce the formation of the arsine gas at the cathodes during electrolysis.

The electrolyte is, preferably, an acidic electrolyte, such as, for example, an aqueous solution containing sulphuric acid and arsenic and copper ions therein. This electrolyte is also preferably maintained at a temperature between about 50° and 75° C. during the electrodeposition and is also preferably circulated at an adequate rate which is usually in the range of about 40 to 70 U.S. gallons per minute for cells having a cathode surface area of about 1,000 square feet each. Lower or higher rates could also be suitable and the novel process is certainly not restricted by the preferred flow rates mentioned above.

The initial arsenic concentration of the electrolyte can vary within a wide range; for example, it can extend from less than 1 gram per liter to about 30 grams per liter. This is the normal range for arsenic containing electrolytes occurring in industry. Furthermore, the anode used in such electrodeposition is preferably an insoluble anode, for instance, made of lead or lead alloys, while the cathode is usually made of a metal such as copper or stainless steel.

The current density normally applied during such electrodeposition would vary between about 5 and about 30 amps. per square foot. In the case of periodically reversed current, the forward current may be applied during periods of 5–30 seconds and the reverse current during periods of 1–4 seconds alternating with the forward current application while the ratio of the duration of reversed to forward current application is usually between ½ and 1/10. In the case of periodically interrupted current, the forward current may be applied during periods of 2–30 seconds, preferably 2–15 seconds, and the interruptions (zero current pulse durations) are normally 1–6 seconds, preferably 1–3 seconds, while the ratio of zero to forward current pulse durations is usually between ⅔ and 1/10. The preferred current density range under periodically interrupted current conditions is between about 10 and about 20 amps. per square foot.

In its most preferred embodiment, the present application provides a method of purification of copper refinery electrolyte, which comprises passing the electrolyte through electrolytic cells containing insoluble anodes, applying a direct current through these cells so as to co-deposit copper, arsenic, antimony and bismuth present in the electrolyte onto cathodes in these cells, and periodically interrupting said current or reversing the polarity of said current such as to minimize or substantially reduce the formation of arsine gas during the co-deposition of copper and arsenic onto the cathodes. Under these conditions, the electrolyte entering the cells will usually contain about 6 to about 12 grams per liter of Cu and about 4 to about 8 grams per liter of arsenic and the codeposition of copper and arsenic will be permitted to proceed until the electrolyte leaving the cells contains between about 0.3 and about 1 gram per liter of Cu and between about 1 and about 2 grams per liter of As.

In this operation, each of the cells employed has a cathode surface area of about 1,000 square feet and contains about 1,400 U.S. gallons of electrolyte. The flow rate of the electrolyte through these cells is preferably maintained between about 40 and about 70 gallons per minute during the co-deposition of copper and arsenic onto the cathodes which are preferably made of copper starting sheets. The temperature of the electrolyte is also preferably maintained between about 50° C. and about 75° C. and the current density between about 10 and about 25 amps. per square foot.

It is also possible to vary the current density during the codeposition of copper and arsenic, particularly under conditions of periodically reversed current. Thus, the initial current density may be maintained near the lower limit of about 10 amps. per square foot and, after a few hours of operation, it can be increased to near the higher limit of about 25 amps. per square foot, without producing any substantial increase in the arsine gas evolution.

In addition to arsenic and copper, the electrolyte entering the cells will usually contain small amounts (about 0.1 to about 0.4 grams per liter) of Sb and of Bi and the electrolyte leaving these cells will have reduced each of these elements to about 0.01–0.05 grams per liter.

The invention will now be described with reference to the following non-limitative examples which illustrate the preferred operating conditions as well as the advantages of the novel process.

EXAMPLES 1 TO 11

Eleven experimental examples of the purification of electrolyte under periodically reversed current (PRC) and direct current (DC) electrolysis conditions (eight examples with PRC and three examples with DC) were carried out on a laboratory scale in a cell of a 40 liter volume using copper starting sheets as the cathodes and lead-antimony insoluble anodes.

The electrolyte feed rate into the cell was 21 ml/min and the electrolyte was circulated in said cell at a rate of 800 ml/min while the temperature of the electrolyte was maintained at 65° C.

The first eight examples were carried out under PRC conditions having the following characteristics:

Forward current ($I_f$) = 62 amps. (corresponding to 21 amps. per square foot current density).

Reverse current ($I_r$) = 36 amps. (corresponding to 12.2 amps. per square foot current density).

Forward time ($T_f$) = 10 seconds.

Reverse time ($T_r$) = 2 seconds.

The last three examples, namely examples 9, 10 and 11, were carried out under DC conditions with the direct current (I) = 30 amps. (corresponding to 10 amps. per square foot current density).

The results obtained under these experimental conditions were then extrapolated to a full scale plant application for eighteen operational cells, each having about 1,000 square feet in cathode surface area and containing about 1,400 U.S. gallons of electrolyte, and five days of sixteen hours plus two days of twenty-four hours per week of normal operation.

The actual results of the experiments are given in Table I hereafter and the extrapolated full scale plant results are given in Table II hereafter.

TABLE I

RESULTS OF PURIFICATION EXAMPLES CARRIED OUT UNDER PRC AND DC ELECTROLYSIS CONDITIONS

Feed Rate = 21 ml/min (corresponding to 33.7 USG/min for full scale plant)

PRC: $I_f$ = 62 Amp (21 asf)
$I_r$ = 36 Amp (12.2 asf)
$T_f$ = 10 seconds
$T_r$ = 2 seconds Electrolyte Temperature: 65° C.
Electrolyte Recirculation Rate: 800 ml/min (corresponding to 71.5 USG/min for full scale plant)

DC: I = 30 Amp (10 asf)

| Ex. No. | Type of Current | Cu [Cu] gpl In | Cu [Cu] gpl Out | Cu gCu/Amp. hr | Cu % C.E. | As [As] gpL In | As [As] gpL Out | As gAs/Amp. hr | Sb [Sb] gpL In | Sb [Sb] gpL Out | Sb gSb/Amp. hr. | Bi [Bi] gpL In | Bi [Bi] gpL Out | Bi gBi/Amp. hr. | $AsH_3$ Emission mg/amp.hr Upper Limited[3] |
|---|---|---|---|---|---|---|---|---|---|---|---|---|---|---|---|
| 1 | PRC | 7.35 | 0.43 | 0.141 | 11.86 | 5.98 | 3.25[1] | 0.168[2] | 0.220 | 0.101[1] | 0.0043[2] | 0.105 | 0.018[1] | 0.0018[2] | <0.0005 |
| 2 | PRC | 7.35 | 0.46 | 0.139 | 11.80 | 5.98 | 2.50[1] | 0.127[2] | 0.220 | 0.078[1] | 0.0029[2] | 0.105 | 0.01 | 0.0019 | <0.0005 |
| 3 | PRC | 8.90 | 0.46 | 0.171 | 14.46 | 5.83 | 1.80[1] | 0.097[2] | 0.216 | 0.058[1] | 0.0032[2] | 0.105 | 0.01 | 0.0019 | <0.0005 |

TABLE I-continued

RESULTS OF PURIFICATION EXAMPLES CARRIED OUT UNDER PRC AND DC ELECTROLYSIS CONDITIONS

| | | | | | | | | | | | | | | | |
|---|---|---|---|---|---|---|---|---|---|---|---|---|---|---|---|
| 4 | PRC | 11.15 | 0.51 | 0.215 | 18.2 | 5.50 | 1.55[1] | 0.096[2] | 0.216 | 0.05 | 0.0037 | 0.105 | 0.01 | 0.0019 | <0.0005 |
| 5 | PRC | 5.65 | 0.31 | 0.108 | 9.15 | 5.75 | 1.42[1] | 0.116[2] | 0.210 | 0.04 | 0.0034 | 0.109 | 0.01 | 0.0020 | <0.0005 |
| 6 | PRC | 3.25 | 0.18 | 0.062 | 5.26 | 5.87 | 1.23 | 0.097 | 0.218 | 0.03 | 0.0038 | 0.106 | 0.01 | 0.0020 | <0.0005 |
| 7 | PRC | 7.70 | 0.27 | 0.150 | 12.70 | 5.45 | 1.17 | 0.087 | 0.214 | 0.03 | 0.0037 | 0.102 | 0.01 | 0.0019 | <0.0005 |
| 8 | PRC | 7.80 | 0.31 | 0.152 | 12.83 | 7.50 | 1.21[1] | 0.097[2] | 0.224 | 0.03 | 0.0039 | 0.106 | 0.01 | 0.0020 | <0.0005 |
| 9 | DC | 8.50 | 0.38 | 0.341 | 28.74 | 6.10 | 1.19 | 0.206 | 0.246 | 0.03 | 0.0091 | 0.118 | 0.01 | 0.0045 | 0.384 |
| 10 | DC | 10.90 | 0.40 | 0.441 | 37.2 | 5.50 | 1.18 | 0.181 | 0.234 | 0.02 | 0.0090 | 0.122 | 0.01 | 0.0047 | 0.246 |
| 11 | DC | 11.00 | 0.6 | 0.345 | 29.0 | 2.0 | 0.55 | 0.048 | not determined | | The higher ot determined | not determined | | not determined | 3.0[4] |

[1]Equilibrium of the metal species has not yet been reached.
[2]g/Amp.hr are calculated from differences between inlet and outlet concentrations and from the drop in concentrations as a function of time in the electrolysis system.
[3]The rate of $AsH_3$ evolution is the highest value found for any period of time during electrolysis.
[4]The higher arsine emission rate was due to the use of new cathodes.

TABLE II

EXTRAPOLATION OF RESULTS OF PRC AND DC TEST TO FULL SCALE PLANT APPLICATION

No. of Cells = 18
Recirculation Rate = ~70 USG/min per cell
Electrolyte Temperature = 65 ° C.
Solution Feed Rate = 33.7 USG/min (~18,700 USG/month)
Cell Current:PRC: $I_f$ = 21,000 Amp, $T_f$ = 10 seconds
$I_r$ = 12,200 Amp, $T_r$ = 2 seconds
DC : I = 10,000 Amp Operation: 555 hrs/month
(5 days of 16 hours
+ 2 days of 24 hours per week)

| Ex. No. | Type of Current | Cu [Cu] gpl In | Cu [Cu] gpl Out | Cu lb Cu/ Month | Cu % C.E. | As [As] gpl In | As [As] gpl Out | As lb As/ Month | Sb [Sb] gpl In | Sb [Sb] gpl Out | Sb lb Sb/ Month | Bi [Bi] gpl In | Bi [Bi] gpl Out | Bi lb Bi Month | $AsH_3$ Emission lb/hr (Upper Limit) |
|---|---|---|---|---|---|---|---|---|---|---|---|---|---|---|---|
| 1 | PRC | 7.35 | 0.43 | 65169.4 | 11.86 | 5.98 | 3.25 | 77648.6 | 0.220 | 0.101 | 1987.4 | 0.105 | 0.018 | 818.1 | $<4.2.10^{-4}$ |
| 2 | PRC | 7.35 | 0.46 | 64245.0 | 11.80 | 5.98 | 2.50 | 57312.0 | 0.220 | 0.078 | 1340.4 | 0.105 | 0.01 | 887.4 | $<4.2.10^{-4}$ |
| 3 | PRC | 8.90 | 0.46 | 79035.2 | 14.46 | 5.83 | 1.80 | 44833.1 | 0.216 | 0.058 | 1479.0 | 0.105 | 0.01 | 887.4 | $<4.2.10^{-4}$ |
| 4 | PRC | 11.15 | 0.51 | 99371.8 | 18.23 | 5.50 | 1.55 | 44370.6 | 0.216 | 0.05 | 1710.1 | 0.105 | 0.01 | 887.4 | $<4.2.10^{-4}$ |
| 5 | PRC | 5.65 | 0.31 | 49916.9 | 9.15 | 5.75 | 1.42 | 53614.5 | 0.210 | 0.04 | 1571.4 | 0.109 | 0.01 | 929.0 | $<4.2.10^{-4}$ |
| 6 | PRC | 3.25 | 0.18 | 28794.7 | 5.26 | 5.87 | 1.23 | 44833.1 | 0.218 | 0.03 | 1756.3 | 0.106 | 0.01 | 901.3 | $<4.2.10^{-4}$ |
| 7 | PRC | 7.70 | 0.27 | 69329.1 | 12.70 | 5.45 | 1.17 | 40210.9 | 0.214 | 0.03 | 1710.1 | 0.102 | 0.01 | 864.3 | $<4.2.10^{-4}$ |
| 8 | PRC | 7.80 | 0.31 | 70253.5 | 12.83 | 7.50 | 1.21 | 44833.1 | 0.224 | 0.03 | 1802.5 | 0.106 | 0.01 | 901.3 | $<4.2.10^{-4}$ |
| 9 | DC | 8.50 | 0.38 | 75051.5 | 28.74 | 6.10 | 1.19 | 45339.0 | 0.246 | 0.03 | 2002.8 | 0.118 | 0.01 | 999.2 | 0.15 |
| 10 | DC | 10.90 | 0.40 | 97060.5 | 37.2 | 5.50 | 1.18 | 39836.7 | 0.234 | 0.02 | 1980.8 | 0.122 | 0.01 | 1034.4 | 0.10 |
| 11 | DC | 11 | 0.60 | 97267.2 | 29.0 | 2.0 | 0.55 | 13561.2 | N.D. | N.D. | N.D. | N.D. | N.D. | N.D. | 1.19 |

N.D. = Not determined

EXAMPLES 12 TO 26

Fifteen experimental examples of the purification of electrolyte under direct current (DC) electrolysis conditions, periodically reversed current (PRC) electrolysis conditions and periodically interrupted current (PIC) electrolysis conditions (two examples with DC, two examples with PRC and eleven examples with PIC) were carried out on a laboratory scale using 1,500 ml. of bleed-off solution obtained from Canadian Copper Refiners Limited in Montreal East, which was recirculated through a 750 ml. electrolysis cell. Fresh bleed-off solution containing about 10 gpl Cu was continuously fed to the recirculating stream at a rate of 0.6 ml/min to maintain constant solution composition. The recirculation flow rate was of 120 ml/min with the exception of examples 25 and 26, which were aimed at studying the effect of the flow rate. The electrolysis cell contained two lead anodes and one copper cathode centrally located between the two anodes. Each example was started using a fresh cathode surface and lasted for three hours to evaluate the effect of cathode age on the rate of arsine gas evolution.

The results of the experiments are outlined in Tables III and IV which give, for each example, the operating conditions, the rates of copper removal and copper deposition current efficiencies, the rates of arsine gas formation for three different periods during each example (in mg $AsH_3$/amp.hr) and the total amount of arsine gas formed (Table III), as well as the rates of arsenic, antimony and bismuth removal (Table IV).

TABLE III

RESULTS OF MEASUREMENTS OF ARSINE GAS EVOLUTION CARRIED OUT UNDER PRC, DC AND PIC ELECTROLYSIS CONDITIONS

Feed Rate: 0.6 ml/min

| Ex. No. | Type of Current | Current Density (asf)** (For: Rev) | Pulse Duration (sec)** (For: Rev) | Electrolyte Temperature ° C. | $AsH_3$ [Cu] gpl In | $AsH_3$ [Cu] gpl Out | $AsH_3$ g Cu/ Amp hr | $AsH_3$ % CE | Total Emission (mg/amp hr) ½-1 hr | Total Emission (mg/amp hr) 1-½-2hr | Total Emission (mg/amp hr) 2-½-3 hr | $AsH_3$ mg/3 hr |
|---|---|---|---|---|---|---|---|---|---|---|---|---|
| 12 | DC | 10 | — | 50 | 10.3 | 0.4 | 0.149 | 12.5 | 56.25 | 56.25 | 31.25 | 335.0 |
| 13 | DC | 15 | — | 50 | 10.3 | 0.42 | 0.146 | 12.2 | 38.88 | 36.11 | 54.16 | 440.5 |
| 14 | PRC | 15:15 | 10.2 | 50 | 10.3 | 0.4 | 0.099 | 8.3 | 18.00 | 2.61 | 2.83 | 92.8 |
| 15 | PRC | 10:10 | 10:2 | 50 | 10.3 | 1.0 | 0.175 | 14.6 | 3.37 | 0.41 | 0 | 18.6 |
| 16 | PIC | 10:0 | 5:1 | 50 | 10.3 | 0.8 | 0.139 | 11.7 | 9.54 | 4.16 | 4.29 | 45.0 |
| 17 | PIC | 10:0 | 10:2 | 50 | 10.3 | 0.9 | 0.207 | 17.4 | 7.82 | 5.43 | 5.38 | 45.5 |
| 18 | PIC | 10:0 | 6:2 | 50 | 10.3 | 0.7 | 0.190 | 16.1 | 6.75 | 3.54 | 1.87 | 32.5 |
| 19 | PIC | 10:0 | 3:1 | 50 | 10.3 | 0.8 | 0.095 | 8.0 | 8.75 | 4.70 | 3.04 | 43.2 |
| 20 | PIC | 10:0 | 3:2 | 50 | 9.65 | 0.9 | 0.131 | 11.0 | 4.80 | 3.00 | 4.20 | 29.3 |

TABLE III-continued

RESULTS OF MEASUREMENTS OF ARSINE GAS EVOLUTION CARRIED OUT UNDER PRC, DC AND PIC ELECTROLYSIS CONDITIONS

Feed Rate: 0.6 ml/min

| Ex. No. | Type of Current | Current Density (asf)** (For: Rev) | Pulse Duration (sec)** (For: Rev) | Electrolyte Temperature ° C. | $AsH_3$ [Cu] gpl In | $AsH_3$ [Cu] gpl Out | $AsH_3$ g Cu/ Amp hr | $AsH_3$ % CE | Total Emission (mg/amp hr) ½-1 hr | Total Emission (mg/amp hr) 1-½-2hr | Total Emission (mg/amp hr) 2-½-3 hr | $AsH_3$ mg/3 hr |
|---|---|---|---|---|---|---|---|---|---|---|---|---|
| 21 | PIC | 15:0 | 3:2 | 50 | 9.65 | 0.7 | 0.089 | 7.5 | 9.16 | 4.58 | 3.81 | 72.4 |
| 22 | PIC | 15:0 | 5:1 | 50 | 9.65 | 0.56 | 0.090 | 7.5 | 9.78 | 7.15 | 4.30 | 86.7 |
| 23 | PIC | 15:0 | 5:1 | 40 | 9.65 | 0.40 | 0.092 | 7.8 | 21.2 | 9.3 | 10.9 | 158.3 |
| 24 | PIC | 15:0 | 5:1 | 65 | 9.65 | 0.56 | 0.090 | 7.5 | 8.19 | 2.77 | 1.24 | 41.9 |
| 25* | PIC | 15:0 | 5:1 | 50 | 9.65 | 0.7 | 0.089 | 7.5 | 7.30 | 9.90 | 5.60 | 112.1 |
| 26* | PIC | 15:0 | 5:1 | 50 | 9.65 | 0.6 | 0.090 | 7.5 | 8.30 | 4.80 | 5.40 | 80.3 |

*Recirculation flow rate was of 40 ml/min for EX. 25 and 180 ml/min for Ex. 26. All other examples (12 to 24) were carried out using a flow rate of 120 ml/min.
**In the case of PIC examples, "For:Rev" stands for "Forward:Interruption"

TABLE IV

As, Sb and Bi Depletion Rates For Experiments Carried Out Under PRC, DC and PIC Electrolysis Conditions Feed Rate: 0.6 ml/min

| Ex. No. | Type of Current | Current Density (asf)** (For:Rev) | Pulse Duration (sec)** (For:Rev) | Electrolyte Temperature ° C. | As [As] gpl In | As [As] gpl Out | As g As/ Amp hr | Sb [Sb] gpl In | Sb [Sb] gpl Out | Sb g Sb/ Amp hr | Bi [Bi] gpl In | Bi [Bi] gpl Out | Bi g Bi/ Amp hr |
|---|---|---|---|---|---|---|---|---|---|---|---|---|---|
| 12 | DC | 10 | — | 50 | 5.25 | 4.45 | 0.100 | 0.23 | 0.176 | 0.0104 | 0.19 | 0.0163 | 0.003 |
| 13 | DC | 15 | — | 50 | 5.25 | 3.59 | 0.118 | 0.23 | 0.145 | 0.0127 | 0.19 | 0.009 | 0.002 |
| 14 | PRC | 15:15 | 10:2 | 50 | 5.25 | 2.83 | 0.108 | 0.23 | 0.078 | 0.0054 | 0.19 | 0.008 | 0.002 |
| 15 | PRC | 10:10 | 10:2 | 50 | 5.25 | 2.36 | 0.162 | 0.23 | 0.090 | 0.0021 | 0.19 | 0.016 | 0.003 |
| 16 | PIC | 10:0 | 5:1 | 50 | 5.25 | 1.37 | 0.130 | 0.23 | 0.056 | 0.0060 | 0.19 | 0.009 | 0.003 |
| 17 | PIC | 10:0 | 10:2 | 50 | 5.25 | 1.00 | 0.114 | 0.23 | 0.042 | 0.0053 | 0.19 | 0.007 | 0.003 |
| 18 | PIC | 10:0 | 6:2 | 50 | 5.25 | 1.21 | 0.103 | 0.23 | 0.043 | 0.0040 | 0.19 | 0.008 | 0.003 |
| 19 | PIC | 10:0 | 3:1 | 50 | 5.25 | 0.86 | 0.094 | 0.23 | 0.030 | 0.0060 | 0.19 | 0.007 | 0.003 |
| 20 | PIC | 10:0 | 3:2 | 50 | 4.70 | 0.87 | 0.074 | 0.24 | 0.074 | 0.0050 | 0.18 | 0.009 | 0.003 |
| 21 | PIC | 15:0 | 3:2 | 50 | 4.70 | 0.73 | 0.070 | 0.24 | 0.028 | 0.0030 | 0.18 | 0.006 | 0.003 |
| 22 | PIC | 15:0 | 5:1 | 50 | 4.70 | 1.16 | 0.106 | 0.24 | 0.033 | 0.0030 | 0.18 | 0.007 | 0.003 |
| 23 | PIC | 15:0 | 5:1 | 40 | 4.70 | 0.86 | 0.080 | 0.24 | 0.030 | 0.0020 | 0.18 | 0.005 | 0.003 |
| 24 | PIC | 15:0 | 5:1 | 65 | 4.70 | 0.86 | 0.099 | 0.24 | 0.032 | 0.0030 | 0.18 | 0.006 | 0.003 |
| 25* | PIC | 15:0 | 5:1 | 50 | 4.70 | 0.86 | 0.083 | 0.24 | NA | NA | 0.18 | 0.008 | 0.003 |
| 26* | PIC | 15:0 | 5:1 | 50 | 4.70 | 0.74 | 0.074 | 0.24 | 0.026 | 0.0030 | 0.18 | 0.006 | 0.003 |

*Recirculation flow rate was of 40 ml/min for Ex. 25 and 180 ml/min for Ex. 26. All other examples (12 to 24) were carried out using a flow rate of 120 ml/min.
**In the case of PIC examples, "For:Rev" stands for "Forward:Interruption".

The above tables and, particularly the results showing the arsine gas emission, amply demonstrate the substantial decrease in the arsine gas formation and emission when using PRC or PIC conditions, as compared to DC conditions.

The effects of various PRC and PIC conditions, as well as temperature, circulation rate, duration of electrolysis and the like on the novel process were studied and some of these effects are represented in graphical form in the attached drawings in which.

Figure 1:
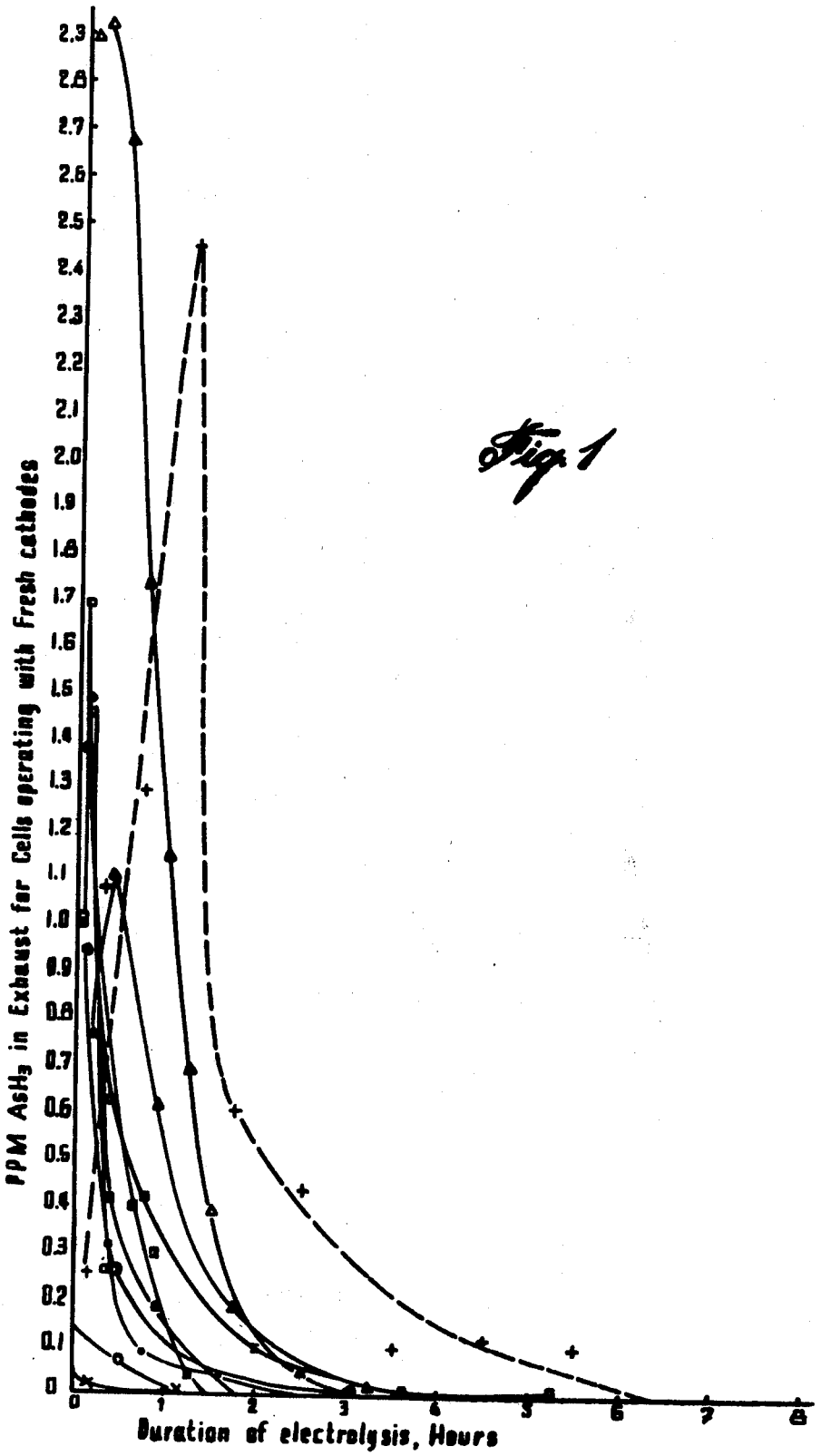
FIG. 1 shows a graph illustrating the variation of arsine concentration in exhaust gas as a function of duration of electrolysis for various PRC conditions for eighteen cells when operating with fresh copper cathodes.

Referring now to FIG. 1, it shows, in graphical form, that various conditions of forward current densities and reverse current densities, as well as forward times and reverse times of electrolysis, lead to different amounts of arsine gas evolutions which has been expressed as pounds of arsine per day in the table and as ppm of arsine in the exhaust air flowing at 20,000 cfm for an eighteen cell plant operation with the use of fresh copper cathodes.

The graph has been drawn using the data of the following Table V, which were obtained experimentally.

TABLE V

Variation of Arsine Concentration in Exhaust Gas as a Function of Time, for Various PRC Conditions for Eighteen Cells Operating with Fresh Cathodes as Illustrated in the Graph of FIG. 1

| Symbols | $I_f$ asf | $I_r$ asf | $T_f$ sec | $T_r$ sec | lb $AsH_3$/day 18 cells | $[Cu]_{out}$ gpl | $[As]_{out}$ gpl |
|---|---|---|---|---|---|---|---|
| X | 10 | 10 | 10 | 2 | 0.01 | 0.75 | 0.9 |
| ○ | 10 | 10 | 10 | 3 | 0.02 | 1.0 | 1.1 |
| ◨ | 10 | 5 | 10 | 3 | 0.13 | 1.0 | 1.4 |
| ◑ | 10 | 15 | 15 | 2 | 0.08 | 0.9 | 1.1 |
| □ | 10 | 10 | 15 | 3 | 0.22 | 1.0 | 1.0 |
| △ | 10 | 7 | 15 | 3 | 0.69 | 0.8 | 1.2 |
| ● | 10 | 10 | 15 | 4 | 0.14 | 1.0 | 1.2 |
| ■ | 10 | 7 | 15 | 4 | 0.17 | 0.85 | 1.2 |
| ▲ | 10 | 5 | 15 | 4 | 0.28 | 0.8 | 1.1 |
| + | 21 | 12 | 10 | 2 | 1.63 | 0.45 | 0.8 |

This graph clearly shows that, after a few hours of operation, in all these cases, the arsine evolution decreases very drastically, which is believed to be due to the fact that, as the process progresses, a powdery deposit of copper and arsenic, as well as other impurities, is obtained on the fresh cathodes, substantially increasing their effective surface and thereby substantially decreasing the effective current density at the cathode to such low levels that, at one point, there is no arsine evolution at all. As already mentioned above, when the current density decreases, the arsine evolution also decreases and, at a certain point, it is entirely eliminated, as this is illustrated in FIG. 1. Obviously, the cathode must be replaced after a certain duration of electrolysis and, therefore, at that stage, the arsine will again begin to evolve for the first several hours of the process. In an eighteen cell purification plant, the replacement of the cathodes can be done at predetermined intervals and in such manner that only a part of the total number of cathodes will be replaced at each particular time, thus even further decreasing the total amount of arsine emission per day.

Obviously, a man of the art can readily select the best conditions for his own plant or purification system, which will give him the most satisfactory results while minimizing the arsine gas emissions in the system or decreasing them to a desired value, depending on the amount of arsenic and/or copper that needs to be removed, or depending on whether PRC or PIC is employed.

For the PRC operations studied by the present applicant, the best conditions exist when $I_f = I_r = 10$ asf and where $T_f = 10$ sec. and $T_r = 2$ or 3 sec.

Figure 2:
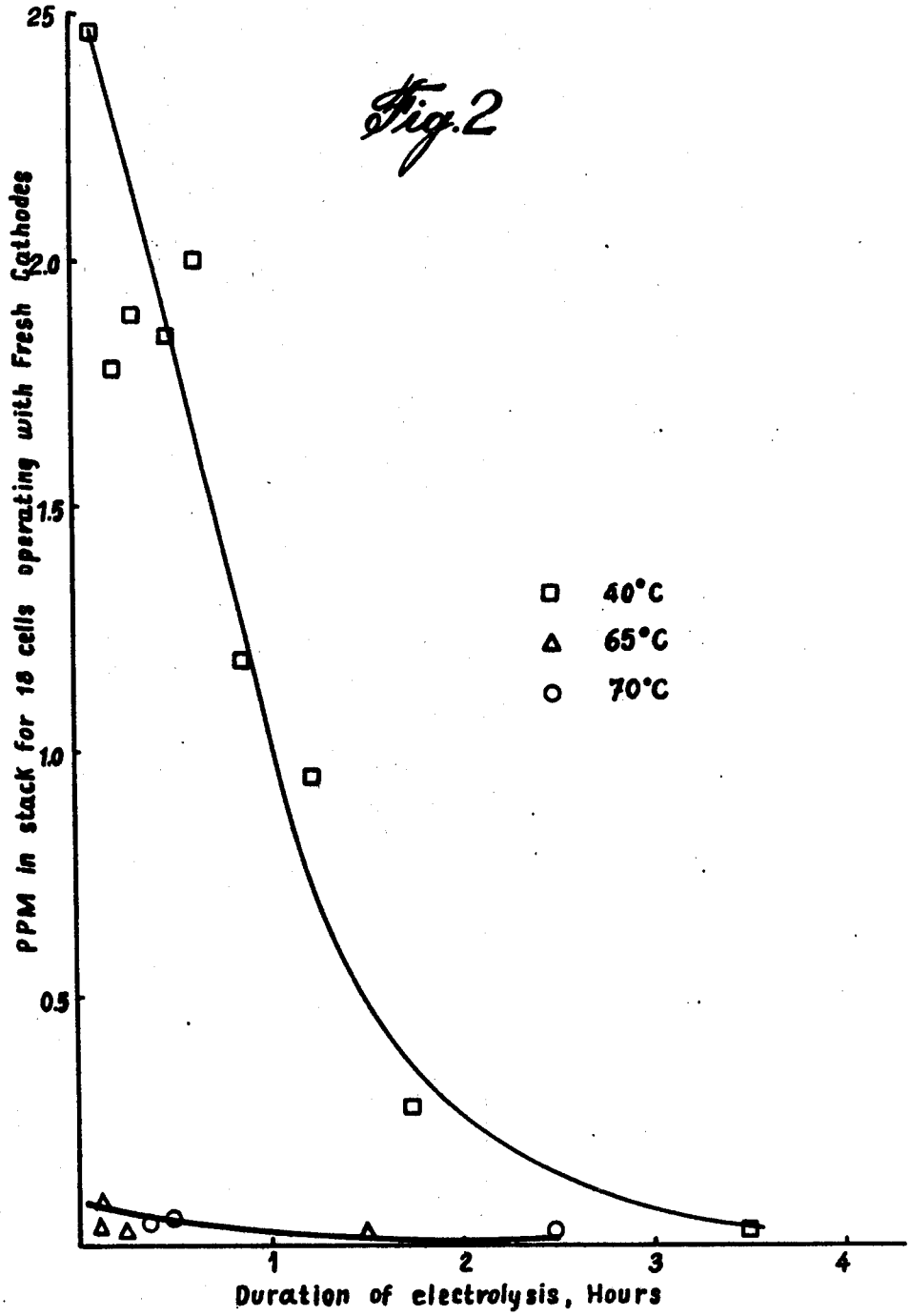
FIG. 2 shows a graph illustrating the effect, under specific PRC conditions, of electrolyte temperature on the arsine gas concentration in the stack.

Referring to FIG. 2, the effect of the electrolyte temperature has been shown to be quite significant under the predetermined PRC conditions where $I_f = 10$ asf, $I_r = 10$ asf, $T_f = 10$ sec. and $T_r = 3$ sec. employed in an 18 cell system with fresh cathodes. From this graph, it will be seen that, when the electrolyte is at 65° or 70° C., there is a much smaller evolution of arsine in an air flow in the stack of 60,000 cfm than at 40° C. Thus, the preferred temperature range for the electrolyte is between about 50° and 75° C.

Under PIC conditions, the effect of variations in the electrolyte temperature on the rate of arsine gas emission is indicated by the results of examples 23 (40° C.), 22 (50° C.), and 24 (65° C.), all carried out at a current density of 15 asf using forward and zero current pulse durations of 5 and 1 second respectively. The results indicate that the rate of arsine gas emission decreased from 158.3 to 86.7 and 41.9 mg/3 hr when the electrolyte temperature is increased from 40° to 50° and 65° C. respectively.

Figure 3:
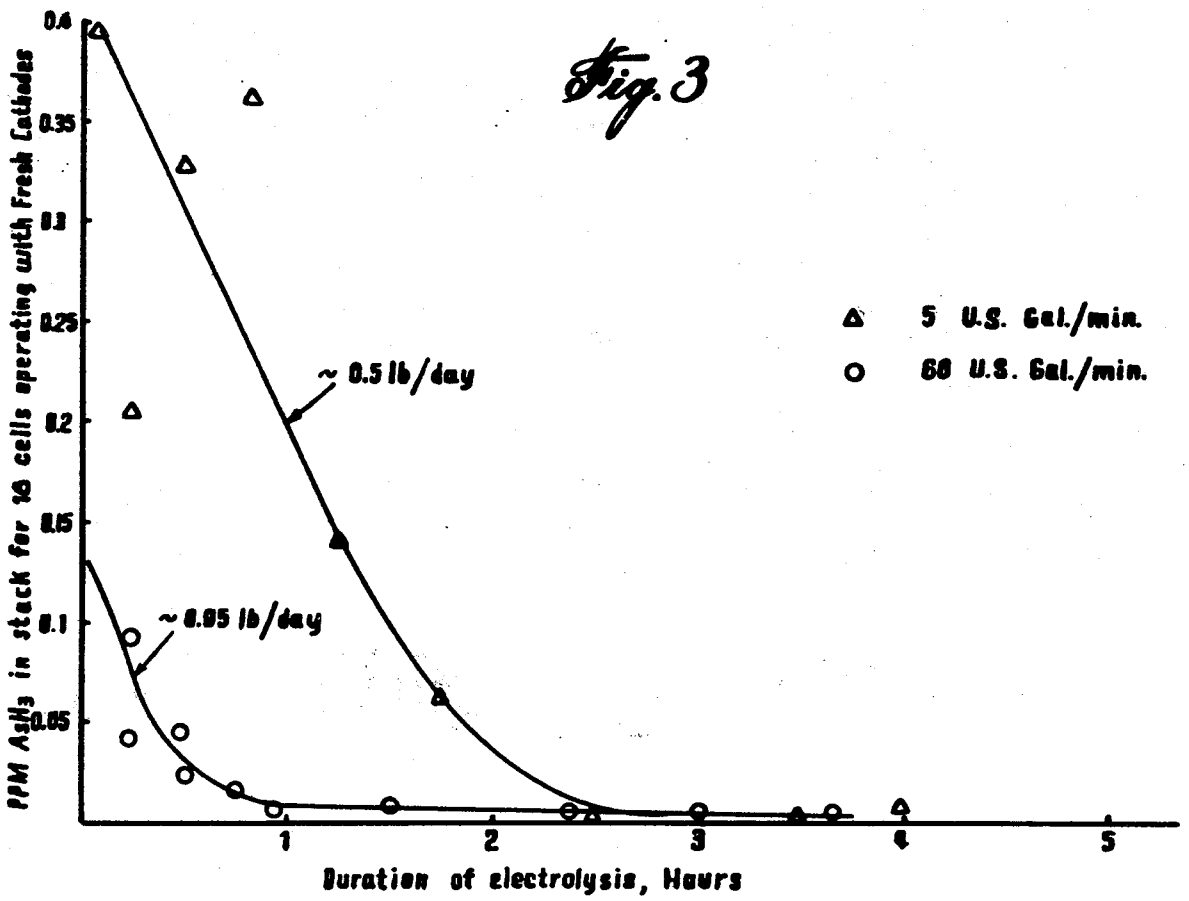
FIG. 3 shows a graph illustrating the effect, under specific PRC conditions, of electrolyte circulation rate on the arsine gas concentration in the stack, for eighteen cells using fresh cathodes.

Referring to FIG. 3, it shows that the effect of the electrolyte circulation may be significant for specific PRC conditions where $I_f = 10$ asf, $I_r = 10$ asf, $T_f = 10$ sec. and $T_r = 3$ sec., again employed in an eighteen cell system with fresh cathodes. When circulation is 5 U.S. gallons per minute, the arsine evolution is higher than when it is 60 U.S. gallons per minute by a ratio of about 10:1. Thus, at 5 U.S. gallons per minute, about 0.5 lbs per day of arsine for eighteen cells will be evolved while at 60 U.S. gallons per minute, only about 0.05 lbs. per day of arsine will be evolved in a stack having an air flow of 60,000 cfm.

Under PIC conditions, a comparison of the results of examples 26, 22 and 25, all carried out at a current density of 15 asf and at a temperature of 50° C., with forward and zero current pulse durations of 5 and 1 seconds respectively, indicates that the arsine gas emission decreases from 112.1 to 82.7 and 80.3 mg/3 hr when the recirculation flow rate is increased from 40 to 120 and 180 ml/min respectively.

Again, a man of the art should have no difficulty in adjusting his specific conditions of temperature and electrolyte circulation to the desired values of arsine elimination and to his desired requirements generally.

Figure 4:
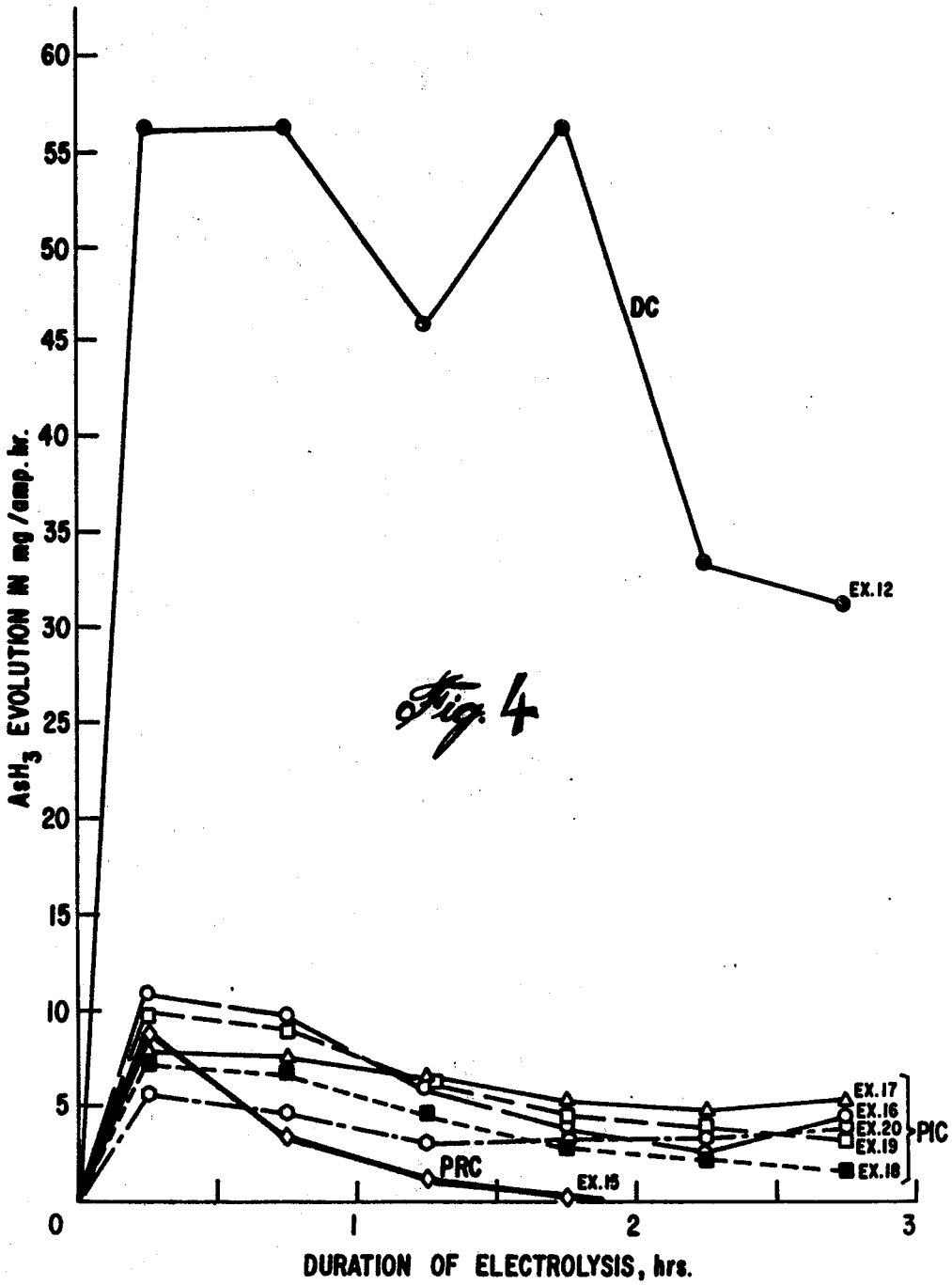
FIG. 4 shows a graph illustrating the variation of arsine gas emission as a function of electrolysis duration for some DC, PRC and PIC examples, at a current density of 10 asf.
Figure 5:
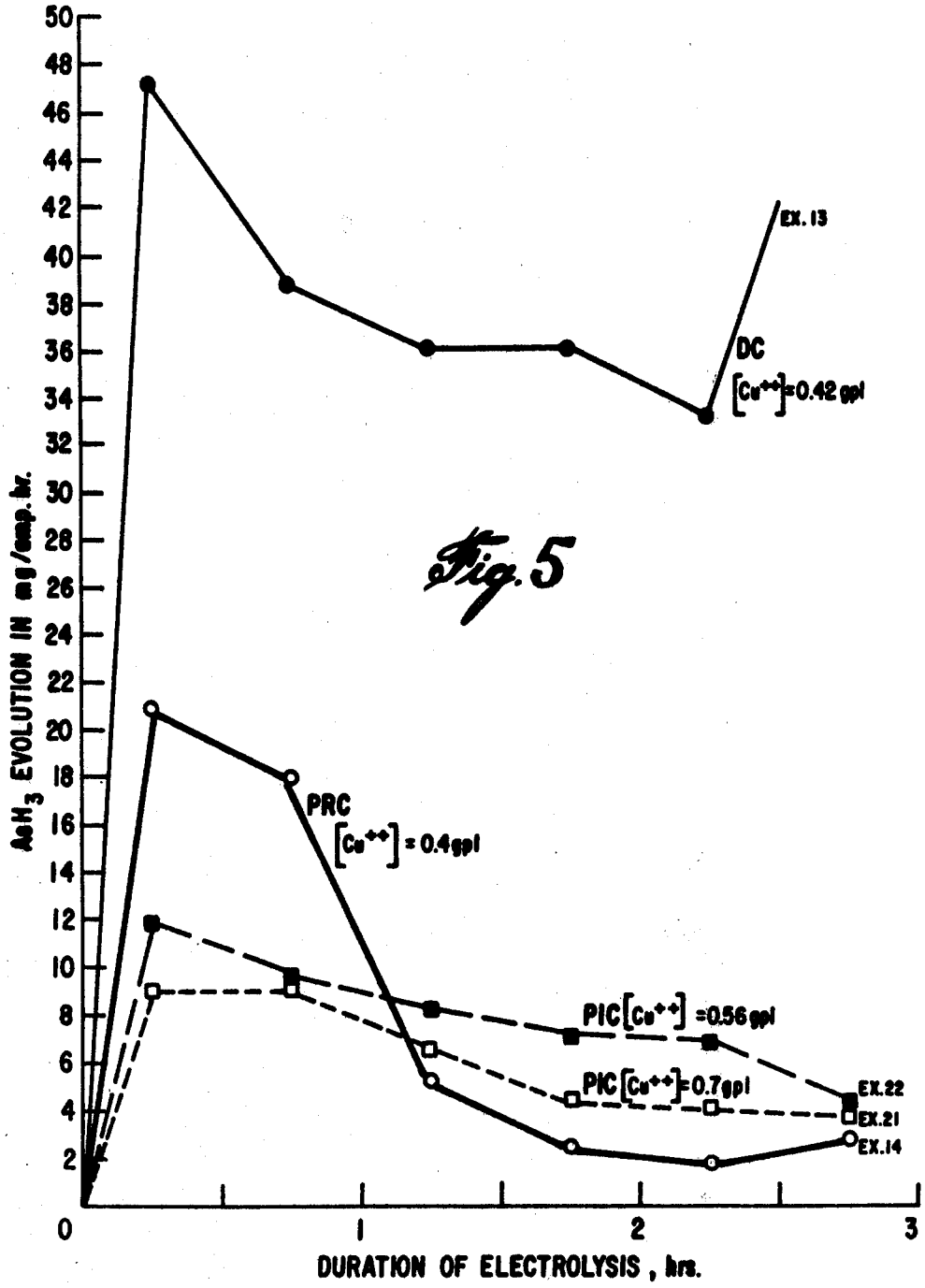
FIG. 5 shows another graph illustrating the variation of arsine gas emission as a function of electrolysis duration for some DC, PRC and PIC examples, at a current density of 15 asf.

Referring to FIGS. 4 and 5, they illustrate the comparative emissions of arsine gas $AsH_3$ in mg/amp.hr for DC, PRC and PIC conditions, at 10 asf and 15 asf respectively and at an electrolyte temperature of 50° C., as a function of electrolysis duration. From these figures, it is clear that both PRC and PIC conditions present very substantial improvement over DC electrolysis. Moreover, it can be seen from FIG. 5 that, under given conditions, arsine evolution under PRC conditions will be greater at the beginning of the electrolysis than arsine evolution under PIC conditions, but as electrolysis progresses, arsine evolution under PRC will fall more drastically than under PIC. Thus, the lowest or minimum arsine gas emissions are obtained with the use of PRC, particularly after the electrolysis has been carried out for a certain period of time, however overall emissions during, let us say three hours of electrolysis, could be more or less equivalent for both PRC and PIC conditions, as illustrated in FIG. 5.

Other effects have also been studied and, for example, in PRC the effect of the reverse pulse duration in seconds for experimental conditions, such as those employed in previous examples, has been tested.

The following Table VI illustrates the results of these tests where arsine gas emission is given for eighteen commercial cells operating at 10 amps. per square foot with fresh cathodes.

TABLE VI

Results Of Tests On Purification Of Arsenic Containing Solutions Under PRC Electrolysis Conditions

| | |
|---|---|
| Feed Rate | : 21 ml/min (corresponding to 33.7 USG/min for full scale plant) |
| Electrolyte Temperature | : 65° C. |
| Electrolyte Recirculation Rate | : 800 ml/min (corresponding to 71.5 USG/min for full scale plant) |
| Feed Concentration | : 7.5 - 8.1 gpl Cu, 4.3 to 5.5 gpl As |
| Forward Pulse current Density | : 10 asf |

Arsine gas emisson is given for all 18 commercial cells operating at 10 asf (10,000 amps) with fresh cathodes
Cu and As concentrations are outlet concentrations from the last purification step.

| Forward Pulse Durations, Seconds | Reverse Pulse Current Densities, asf | Reverse Pulse Duration, Seconds 2 | | | 3 | | | 4 | | |
|---|---|---|---|---|---|---|---|---|---|---|
| | | gpl Cu | gpl As | lb $AsH_3$/day | gpl Cu | gpl As | lb $AsH_3$/day | gpl Cu | gpl As | lb $AsH_3$/day |
| 10 | 15 | — | — | — | — | — | — | — | — | — |
| | 10 | 0.75 | 0.9 | 0.01 | 1.0 | 1.1 | 0.02 | — | — | — |
| | 7 | — | — | — | — | — | — | — | — | |
| | 5 | — | — | — | 1.0 | 1.4 | 0.13 | — | — | — |
| 15 | 15 | 0.9 | 1.1 | 0.08 | — | — | — | — | — | — |
| | 10 | — | — | — | 1.0 | 1.0 | 0.22 | 1.0 | 1.2 | 0.14 |
| | 7 | — | — | — | 0.8 | 1.2 | 0.69 | 0.85 | 1.2 | 0.17 |
| | 5 | — | — | — | — | — | — | 0.8 | 1.1 | 0.28 |

From this table, it is obvious that different forward and reverse pulse durations with different current densities will give different results which can be adjusted to the desired operating conditions. Again, the smallest arsine evolution appears to be when the forward and reverse current densities are at 10 amps. per square foot and the forward pulse is 10 seconds while the reverse pulse is 2 or 3 seconds.

Under PIC conditions, the effect of forward and zero current pulse durations has been studied. The relevant examples for this study are examples 16 through 20 which were all carried out at 10 asf and 50° C.

A comparison of total arsine gas emission obtained during examples 19 and 20 indicates that, for a constant forward current pulse duration of 3 seconds, increasing the duration of the zero current pulse from 1 second (Ex. 19) to 2 seconds (Ex. 20) results in a decrease in arsine gas emission from 43.2 to 29.3 mg/3 hr.

Doubling both forward current and zero current pulse durations has little or no effect on the rate of arsine gas emission, as shown by comparison of the results of examples 19 and 18 ($T_f/T_o$:3/1 to $T_f/T_o$:6/2) and 5 and 6 ($T_f/T_o$:5/1 to $T_f/T_o$:10/2).

For a constant zero current pulse of 2 seconds, increasing the forward current pulse duration from 3 seconds (Ex. 20) to 6 seconds (Ex. 18) and 10 seconds (Ex. 17) has resulted in increased rates of arsine gas emission from 29.3 to 32.5 and 45.5 mg/3 hr respectively.

The applicant has also studied the effect of increasing the current density during the last stage of purification under PRC and PIC conditions. It has generally been observed that, under PRC, the increase of the current density after three or four hours of electrolysis from ten amps. per square foot to 15 or 20 amps. per square foot for the remainder of the electrolysis cycle (which is sixteen hours in the present case) will not cause any significant increase of arsine emission rate since the cathodes will be relatively old and covered with a powdery deposit which decreases the effective current density at the cathodes to a substantial degree.

The effect of varying the current density of the current-on pulse under PIC conditions can be obtained by comparing the results of examples 20 and 21 for a timing of 3 seconds current-on and 2 seconds current-off, and of examples 16 and 22 for a timing of 5 seconds current-on and 1 second current-off. In both cases, the rate of arsine gas emission is higher when the current density is increased to 15 asf (29.3 to 72.4 and 45.0 to 86.7 mg/3 hr.)

The efficiency of copper, arsenic and antimony removal also tends to be favoured by operation at 10 asf than at 15 asf. The efficiency of bismuth removal is low and unaffected by variation of the current density.

It should also be mentioned that the novel method can be applied to various electrolysis systems. For example, a continuous feed and withdrawal system with recirculation of electrolyte can be employed. Also, the so-called "cascade" system where the electrolyte is passed through a plurality of cells in series can be used. Finally, a batch system in which the electrolyte remains in the cell under agitation until the desired levels of copper and arsenic are achieved can also be employed. In the case of a batch type operation, electrolysis experiments have been carried out using small scale cells (700 ml in volume) and large scale cells (40 liters in volume) to compare the amount of arsine gas evolved under both DC and PRC electrolysis conditions. The electrolyte in these cells, which contained 6 to 10 gpl copper and about 6 gpl arsenic, was agitated and decopperized to low concentrations. The electrolyte temperature was maintained at 60 to 65° C. The agitation, in both cases, (small and large scale) was maintained such as to correspond to a flow rate of the electrolyte of 60 U.S. gallons per minute in a commercial cell having about 1,000 sq. ft. of cathode surface area.

The PRC conditions were:

1. For the small scale experiment:

$I_f = 21$ asf $I_r = 17$ asf $T_f = 10$ sec.

$T_r = 2$ sec.

2. For the large scale experiments:

$I_f = I_r = 21$ asf $T_f = 10$ sec. $T_r = 2$ sec.; and $I_f = 15$ asf $I_r = 10$ asf $T_f = 10$ sec. $T_r = 2$ sec.

The results are shown in the following Table VII where the arsine emission rates under PRC and DC conditions are given. It can again be concluded from these results that the application of PRC electrolysis during decopperization causes a drastic reduction of arsine gas evolution.

TABLE VII

| Type of Electrolysis | Cell Capacity | Arsine Gas Evolution Rate (mg/amp.hr.) at 0.52–0.57 gpl Cu | 0.3–0.34 gpl Cu |
|---|---|---|---|
| PRC 21 asf | 0.7 liters | 0.513 | 2.05 |
| DC 21 asf | | 12.89 | 39.4 |
| PRC 21 asf | 40 liters | 0 | 0.042 |
| PRC 15 asf | | 0 | 0 |
| DC | | 7.0 | 9.7 |
| DC | | 4.7 | 9.0 |

A full scale purification plant based on this process with the use of PRC has been built at Canadian Copper Refiners Limited in Montreal East. This plant comprises twenty-seven liberator cells which regulate the copper levels in the electrolyte, in which the copper is plated out of the tankhouse electrolyte to about 30 gpl Cu. About 70% of the electrolyte is then returned to the tankhouse and 30% is treated further in nine cells that deplete copper to about 9 gpl Cu.

The electrolyte from these nine cells depleted to about 9 gpl Cu is then fed into eighteen purification cells forming the purification process under periodically reversed current conditions, described above. Each purification cell has a cathode surface area of about 1,000 sq. ft. In these cells, the electrolyte is recirculated at the rate of 50 U.S. gallons per minute per cell and the copper depletion proceeds under PRC conditions to about 0.4 gpl.

The operating data of a test run carried out in this plant were as follows:

Operating Data

Current Density: Forward 14.7 asf — Reverse 10.6 asf

Pulse Duration: Forward 10 sec. — Reverse 2 sec.

Air Flow in Stack: 60,000 cfm

Arsine in Stack: Avg. oper. conditions: 20 ppb (parts per billion) — New cath. in one tier: 200 ppb (parts per billion)

Circulation rate: 50 U.S.G.P.M. per cell

Temperature: 60°–65° C.

Feed Solution Analysis: Cu 9.4 gpl, As 6.18 gpl, Sb 0.38 gpl, Bi 0.28 gpl.

Rate of Introduction of Feed Solution: 24 U.S.G.P.M. Outlet Solution Analysis: Cu 0.36 gpl, As 1.70 gpl, Sb 0.08 gpl, Bi 0.02 gpl.

Two automatic arsine detectors are used to monitor the workroom environment and the stack emissions. A third detector acts as a spare. The arsine monitor in the stack is set to cut off the power from both the liberator and the purification rectifiers when the stack emission reaches a predetermined value of arsine. The arsine evolution has been less than 1 lb. per day and the upper limit in the stack has been set at 1.5 ppm.

The plant has been test run for some time and has operated satisfactorily providing a purification of the solution with removal of about 1,000 lbs. of arsenic per day, which is deposited on the cathodes together with copper, bismuth and antimony. These cathodes are then removed and sent to the smelter for further treatment, such as recovery of the copper.

This is believed to be a remarkable achievement which provides a substantial improvement over the known prior art in the field of copper refinery electrolyte purification by minimizing the arsine emissions and thereby the health and/or pollution hazard that they provoke. A substantial contribution has, therefore, been made in the art of arsenic electrodeposition generally and in the art of copper refinery electrolyte purification in particular.

When comparison is made between results obtained under PRC and PIC with regard to various operating conditions as well as arsine gas emissions, the following observations can be made:

The range of suitable temperatures, the effect of electrolyte circulation, the ranges of suitable initial and final concentrations of Cu, As, Bi and Sb, and the effect of cathode ageing, are all similar for both PRC and PIC applications. The cathode ageing effect on the rate of arsine gas evolution is, however, not as pronounced for PIC as it is for PRC electrolysis. Thus, the lowest emissions of arsine gas are obtained under PRC conditions, particularly after several hours of operations, whereas slightly higher emissions (but which are still substantially lower than those obtained under DC conditions) are produced under PIC conditions. The PIC system, however, has one important advantage over the PRC system, in that it requires only one source of power supply and uses less electric power, thereby making it simpler and less expensive, while still producing acceptably low rates of arsine gas emission.

From the foregoing results, it is also obvious that the invention is not limited to the specific conditions given in the above examples, but rather provides a new principle of electrodeposition of arsenic, eventually in combination with other elements, while minimizing or substantially reducing arsine emission by the use of periodically reversed or interrupted current.

What is claimed is:

1. In a method of removing arsenic from electrolytes containing arsenic and copper within electrolytic cells having cathodes and insoluble anodes, wherein the copper concentration of the electrolyte reaches such low levels that toxic arsine gas would be formed at the cathodes during electrolysis, and which comprises applying a direct current through said cells so as to co-deposit arsenic and copper present in the electrolyte onto the cathodes, the improvement comprising periodically interrupting said direct current such as to substantially reduce the formation of the toxic arsine gas at the cathodes.

2. Method according to claim 1, wherein said electrolyte is an acidic electrolyte.

3. Method according to claim 2, wherein said electrolyte is an aqueous-sulphuric acid solution containing at least arsenic and copper ions.

4. Method according to claim 1, wherein said electrolyte is maintained at a temperature between about 50° C. and 75° C. during electrolysis.

5. Method according to claim 1, wherein said electrolyte is circulated during electrolysis.

6. Method according to claim 1, wherein the initial arsenic concentration of said electrolyte is up to about 30 grams per liter.

7. Method according to claim 1, wherein the direct current applied through the electrolyte has a current density of between about 5 and about 30 amps per square foot and said direct current is applied for periods of 2 to 30 seconds and is interrupted for periods of 1 to 6 seconds, with the ratio of zero to forward current duration being between ⅔ and 1/10.

8. Method according to claim 1, wherein the cathodes are made of copper.

9. In a method of purifying a copper refinery electrolyte wherein the copper concentration of the electrolyte reaches such low levels that toxic arsine gas would be formed at the cathodes during electrolysis which comprises passing an electrolyte containing copper, arsenic, antimony and bismuth through electrolytic cells having cathodes and insoluble anodes and applying a direct current through said cells so as to co-deposit copper, arsenic, antimony and bismuth onto the cathodes, the improvement comprising periodically interrupting said direct current in said cells such as to substantially reduce the formation of arsine gas at the cathodes.

10. Method according to claim 9, wherein the electrolyte entering the cells contains about 6 to about 12 grams per liter of Cu and about 4 to about 8 grams per liter of As and the co-deposition of copper and arsenic is permitted to proceed until the electrolyte leaving said cells contains between about 0.3 and about 1 gram per liter of Cu and between about 1 and about 2 grams per liter of As.

11. Method according to claim 9, wherein cells, each having a cathode surface area of about 1,000 sq. ft., are used and the flow rate of the electrolyte through these cells is maintained between about 40 and about 70 gallons per minute during the co-deposition of copper and arsenic onto the cathodes.

12. Method according to claim 9, wherein the temperature of the electrolyte in the cells is maintained between about 50° C. and about 75° C.

13. Method according to claim 9, wherein the current density is maintained between about 10 and about 20 amps. per square foot.

14. Method according to claim 13, wherein the forward current is applied for periods of 2 to 30 seconds and the interruptions are made for periods of 1 to 6 seconds, with the ratio of zero to forward pulse durations being between ⅔ and 1/10.

15. Method according to claim 14, wherein the forward current is applied for periods of 2 to 15 seconds and the interruptions are made for periods of 1 to 3 seconds.

16. Method according to claim 9, wherein the insoluble anodes are made of lead or lead alloys and the cathodes are made of copper or stainless steel.

17. Method according to claim 9, wherein the electrolyte entering the cells contains about 0.1 to about 0.4 gpl of Sb and of Bi and the electrolyte leaving said cells contains about 0.01 to about 0.05 gpl of Sb and of Bi.

18. Method according to claim 9, which is applied to a continuous feed and withdrawal system with the recirculation of the electrolyte.

19. Method according to claim 9, which is applied to a cascade system where the electrolyte is passed through a plurality of cells in series.

20. Method according to claim 9, which is applied to a batch system where the electrolyte remains in the cell under agitation until the desired levels of copper and arsenic are achieved.

* * * * *